United States Patent [19]

Johnson et al.

[11] Patent Number: 4,858,694

[45] Date of Patent: Aug. 22, 1989

[54] HEAVE COMPENSATED STABBING AND LANDING TOOL

[75] Inventors: Dale V. Johnson, Metairie; Joseph A. Burkhardt, New Orleans, both of La.; Thomas W. Childers, Hosle, Norway

[73] Assignee: Exxon Production Research Company, Houston, Tex.

[21] Appl. No.: 156,053

[22] Filed: Feb. 16, 1988

[51] Int. Cl.[4] ..... E21B 19/00

[52] U.S. Cl. ..... 166/355; 175/5; 294/82.16

[58] Field of Search ..... 166/355, 358, 360, 383; 175/5, 7; 254/106; 294/82.16

[56] References Cited

U.S. PATENT DOCUMENTS

| | | | |
|---|---|---|---|
| Re. 27,724 | 8/1973 | Johnson . | |
| Re. 28,218 | 10/1974 | Hanes et al. . | |
| Re. 29,564 | 3/1978 | Larralde et al. . | |
| Re. 29,565 | 3/1978 | Hawley et al. . | |
| 3,365,762 | 1/1968 | Spiri . | |
| 3,571,865 | 3/1971 | Johnson . | |
| 3,687,205 | 8/1972 | Mori . | |
| 3,718,316 | 2/1973 | Larralde et al. . | |
| 3,804,183 | 4/1974 | Duncan et al. . | |
| 3,834,672 | 9/1974 | Hawley et al. . | |
| 3,841,607 | 10/1974 | Larralde et al. . | |
| 3,846,877 | 11/1974 | Spiri . | |
| 3,871,622 | 3/1975 | Larralde et al. . | |
| 3,916,500 | 11/1975 | Brown . | |
| 4,003,472 | 1/1977 | Reynolds et al. . | |
| 4,121,806 | 10/1978 | Iato et al. | 294/82.16 X |
| 4,251,176 | 2/1981 | Sizer et al. | 175/5 X |
| 4,405,115 | 9/1983 | Boyadjieff | 254/106 |
| 4,413,387 | 11/1983 | Guier . | |
| 4,537,533 | 8/1985 | Hampton . | |
| 4,595,062 | 6/1986 | Boyadjieff et al. . | |

OTHER PUBLICATIONS

Wireline Well Logging, p. 96, FIG. 2.2.

Wireline Completion of Subsea Well, Georges Houot and Jean-Pierre Issarts, Offshore Drilling & Producing Technology, Petroleum Engineer Publishing Co., 1976.

*Primary Examiner*—William P. Neuder

*Attorney, Agent, or Firm*—Herbert E. O'Niell

[57] ABSTRACT

A heave compensated stabbing and landing tool and method for use on a floating platform comprises a tool attached to a heave compensator on the floating platform. The tool, attached at one end to a taut line anchored to the seabed, includes means for gripping, raising and lowering a tubing string. The tool is attached to the heave compensator, which is raised to tighten the anchor line and substantially eliminate relative motion between the end of the tubing string and the seabed. The tool grips the tubing string and lowers it to the seabed in a controlled manner.

9 Claims, 3 Drawing Sheets

FIG. 2
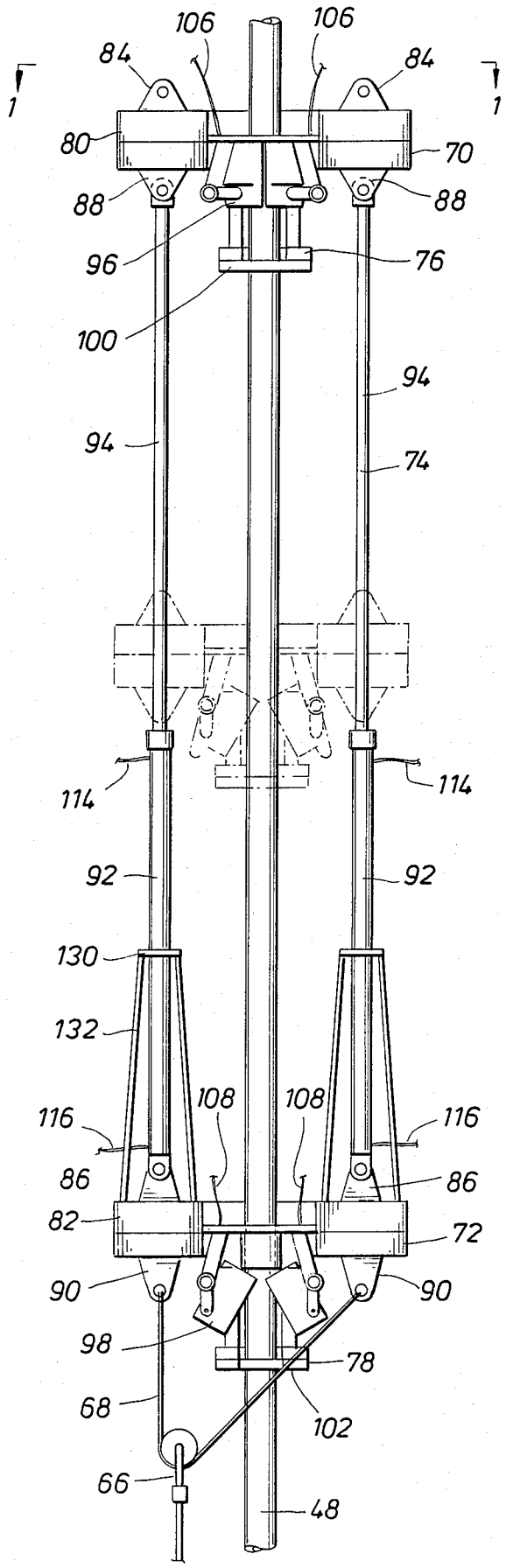
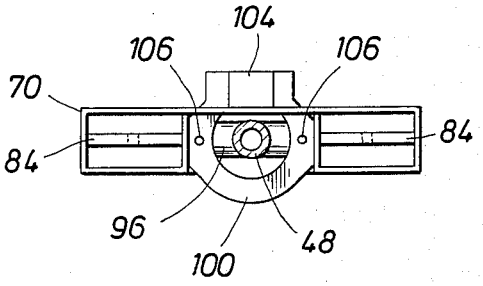
FIG. 3

HEAVE COMPENSATED STABBING AND LANDING TOOL

BACKGROUND OF THE INVENTION

The present invention relates generally to offshore oil and gas drilling, completion, and maintenance operations. More particularly, the present invention relates to apparatus for minimizing the effects of vessel heave during stabbing and landing operations.

In the drilling, completion, and maintenance of many offshore oil and gas wells, it is necessary to stab tubing strings into boreholes and land large equipment packages onto the seabed from a floating vessel These operations often require precise placement of the equipment. Wind, wave, and current induced forces cause relative motion between the floating vessel and the seabed. This relative motion in the vertical direction is termed "heave." Control over movement of the package is needed to minimize the risk of misplacement or damage to the equipment due to heave.

Critical operations such as, for example, landing a Christmas tree, replacing an equipment skid or manifold, or reentering a borehole with a drill bit and drill string require a great deal of precision and control and, therefore, a minimum of relative motion, or heave, between the equipment package and the seabed. Operations may be delayed until the weather and seas are calm. However, a more practical solution is to use heave compensation to avoid loss of rig time.

Heave compensators, also called drill string compensators, are currently utilized in drilling operations to maintain a relatively constant weight on the drill bit and drill string by compensating for the relative vertical movement of a floating drilling vessel with respect to the earth due to heave. Most heave compensators are either integral with the crown block or attached to the traveling block. They bias the drill string with respect to the heaving vessel in order to keep a relatively constant weight on the bit, and thereby maintain the drill string reasonably stationary with respect to the earth. Examples of heave compensation apparatus are disclosed and described in U.S. Pat. Nos. 3,163,005, 3,804,183, 3,834,672, RE 29,564, and RE 29,565.

Heave compensators generally comprise hydraulic and pneumatic systems which adjust the relative elevation of the tubing string with respect to the floating vessel based on the tension in the tubing string. As the weight applied to the tubing string varies due to vertical movement of the floating vessel, the heave compensator reacts to either raise or lower the tubing string in the direction opposite the movement of the vessel. This tends to maintain the desired tension in the tubing string and the relative position of the tubing string with respect to the earth even though the vessel is heaving.

While the heave compensators described above are generally capable of sufficiently compensating for the effects of heave on a drill string in most operations, they still allow some degree of uncompensated relative movement between the drill and the earth. These apparatus are not entirely effective in stabbing and landing operations. Such operations would benefit from a near elimination of the effects of vessel heave on the tubing string and great precision and control over movement of the tubing string in general In addition, the heave compensation apparatus described above are also not entirely effective in operations in which the weight of the drill string is minimal.

Another approach to heave compensation has been used in offshore wireline well logging. There, a tensioned line connected to the marine riser runs over a sheave connected to the vessel's heave compensator and connects to a fixed point in the vessel. This makes the lower end of the heave compensator a relatively vertically stationary point with respect to the marine riser, because relative motion between the vessel and the lower end of the heave compensator is accommodated by the heave compensator. Logging operations are conducted using a sheave connected to the lower end of the heave compensator. This approach still permits some relative movement between the vessel and the earth.

The present invention overcomes the deficiencies in the prior art by providing an apparatus and system which allow the stabbing and landing of equipment packages onto the seabed while nullifying the effects of the vertical motion of the floating vessel due to heave on the tubing string.

SUMMARY OF THE INVENTION

In accordance with the present invention, there is provided a heave compensated stabbing and landing tool and method for use on a floating platform. The invention comprises an apparatus and method for substantially eliminating relative motion between an item on the end of a tubing string and the seabed. The apparatus comprises a tool attached to a heave compensator on the floating platform and to a taut line anchored to the seabed. The tool alternately grips the tubing string, and lowers or pulls it down in a controlled manner to stab or land the item at the seabed.

These and other features and advantages of the present invention will be more readily understood by those skilled in the art from a reading of the following detailed description with reference to the accompanying drawings.

BRIEF DESCRIPTION OF THE DRAWINGS

FIG. 2 is a side view of the heave compensated stabbing and landing tool of FIG. 1.

FIG. 3 is a top view of the upper spider assembly of the heave compensated stabbing and landing tool taken along line 1—1 of FIG. 2.

DETAILED DESCRIPTION OF THE PREFERRED EMBODIMENT

Figure 1:
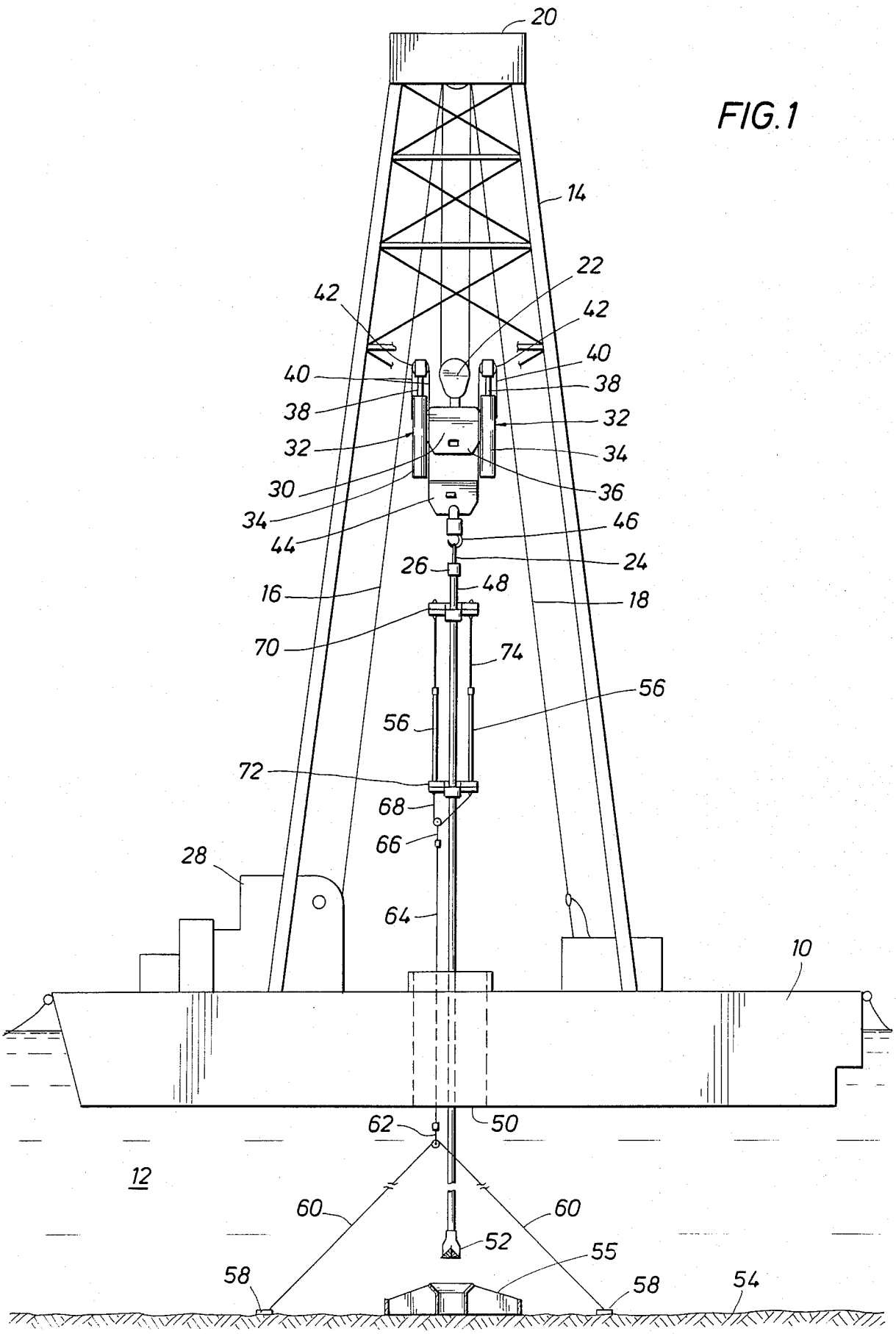
FIG. 1 is a side view of a floating offshore drilling vessel showing a heave compensated stabbing and landing tool in accordance with the present invention in place mounted on a drill string.

Referring to FIG. 1, there is shown an offshore vessel 10, such as a drilling vessel or a barge, anchored and floating in a body of water 12 and on which is arranged conventional equipment including a derrick 14, a live line 16, a dead line 18, a block assembly including a crown block 20 and a traveling block 22, elevators 24, a swivel 26, and a draw works 28. Other equipment is also included on drilling vessel 10 depending upon the desired operations. For example, in a drilling operation a rotary table (not shown) may be mounted with drilling vessel 10, and a kelly and drilling fluid conduit (not shown) may be connected to swivel 26.

The block assembly also includes a drill string compensator, or heave compensator, 30. The drill string compensator 30 is a motion compensation system which compensates for the relative vertical motion effects a drill string due to the movement of floating vessel 10 from heave. The drill string compensator 30 may be integral with the crown block 20 or may be attached to the traveling block 22, and may comprise any one of a number of known compensators such as, for example, those disclosed and described in U.S. Pat. Nos. 3,163,005, 3,804,183, 3,834,672, RE 29,564, and RE 29,565.

As depicted in FIG. 1, the drill string compensator 30 is attached to the traveling block 22 and comprises dual hydraulic or pneumatic vertical piston assemblies 32. The piston cylinders 34 of the piston assemblies 32 are mounted onto a main frame 36 attached to the traveling block 22. The main frame 36, therefore, will be stationary with respect to the traveling block 22. The piston rods 38 of the piston assemblies 32 are attached to chain sheaves 42. Chains 40 run over chain sheaves 42 and are connected at one end to the main frame 36 and at the other end to the hook frame 44. The hook frame 44, therefore, will move vertically upward in response to upward motion of piston rods 38 and vertically downward in response to downward motion of the piston rods 38. A hook 46, elevators 24, swivel 26, and tubing string 48 are attached to the base of hook frame 44. Other details of drill string compensator 30 necessary to an understanding of the present invention can be had by referring to the above patents.

The tubing string 48 is suspended from the base of the drill string compensator 30 by the hook 46, elevators 24, and swivel 26. The tubing string 48 extends from the drill string compensator 30, through an opening 50 in the floor of drilling vessel 10 and into the body of water 12. Attached to the base of the tubing string 48 is an equipment package 52, such as the drill bit shown, which may comprise any of a variety of equipment for landing on the seabed 54 or stabbing into a template 55 over the borehole at the seabed 54. For example, the equipment package 52 may be a Christmas tree or a blowout preventer to be landed on the template at seabed 54, or a drill bit to be stabbed into the borehole to resume drilling operations. Stabbing or landing the package 52 requires great control and precision over its movements and, therefore, a minimum of uncompensated motion resulting from heaving of the vessel 10, to minimize the chances of damaging the equipment package and other equipment on the vessel 10 or the seabed.

To provide such precision and control, a heave compensated stabbing and landing tool 56 (hereinafter referred to as the landing tool 56) is attached to tubing string 48. As shown in FIG. 1, the landing tool 56 is anchored to the seabed 54 through anchors 58 set in the seabed 54. The anchors may be piles or any other type of anchoring device. A line 60 is attached to the anchors 58 and is connected to a first pulley and load cell assembly 62. A guideline 64 connects the first pulley and load cell assembly to a second pulley and load cell assembly 66 and a line 68 attached to the base of the landing tool 56.

Referring to FIGS. 2 and 3, there is illustrated in greater detail the landing tool 56 of FIG. 1. The tool in its simplest form comprises upper and lower tubing grips connected by cylinder and piston assemblies for selectively varying the distance between the tubing grips. In the preferred embodiment, the landing tool 56 comprises an upper spider assembly 70 connected to a lower spider assembly 72 by piston assemblies 74. The spider assemblies include slips that may be selectively engaged or disengaged to grip or release the tubing string. Spider assembly, as used herein, is intended to include other tubing gripping devices, as applicable. Upper and lower spider assemblies 70 and 72 are identical in construction and generally comprise spiders 76 and 78, respectively, mounted on frames 80 and 82, respectively. Also mounted on frames 80 and 82 are upper bearing pads 84 and 86, respectively, and lower bearing pads 88 and 90, respectively. Upper bearing pads 86 connect the lower spider assembly 72 to the cylinders 92 of piston assemblies 74, lower bearing pads 88 connect the upper spider assembly 70 to the rods 94 of piston assemblies 74, and lower bearing pads 90 are connected to line 68 of the anchoring arrangement as described above.

Spiders 76 and 78 may comprise any one of a number of hydraulic, pneumatic, mechanical and/or electromechanical spiders or pipe slips utilized in oilfield operations and familiar to those skilled in the art such as, for example, those disclosed and described in U.S. Pat. Nos. 3,365,726 and 3,846,877. As shown in FIGS. 2 and 3, spiders 76 and 78 comprise grips 96 and 98 mounted to housings 100 and 102, respectively. Grip 96 is shown in the closed position clamping onto drill pipe 48, and grip 98 is shown in the open position released from drill pipe 48. Housings 100 and 102 are provided with gates 104 which open and allow drill pipe 48 to be inserted and removed from the spiders 76 and 78. When closed, the spiders will hold the drill pipe 48 within the housings 100 and 102 for the landing or stabbing operations. Lines 106 and 108 are connected to grips 96 and 98, respectively, to transmit the required hydraulic, pneumatic, mechanical, or electromechanical energy to open and close the grips 96 and 98. Other details of the spiders 76 and 78 are shown in the patents mentioned above.

Figure 4:
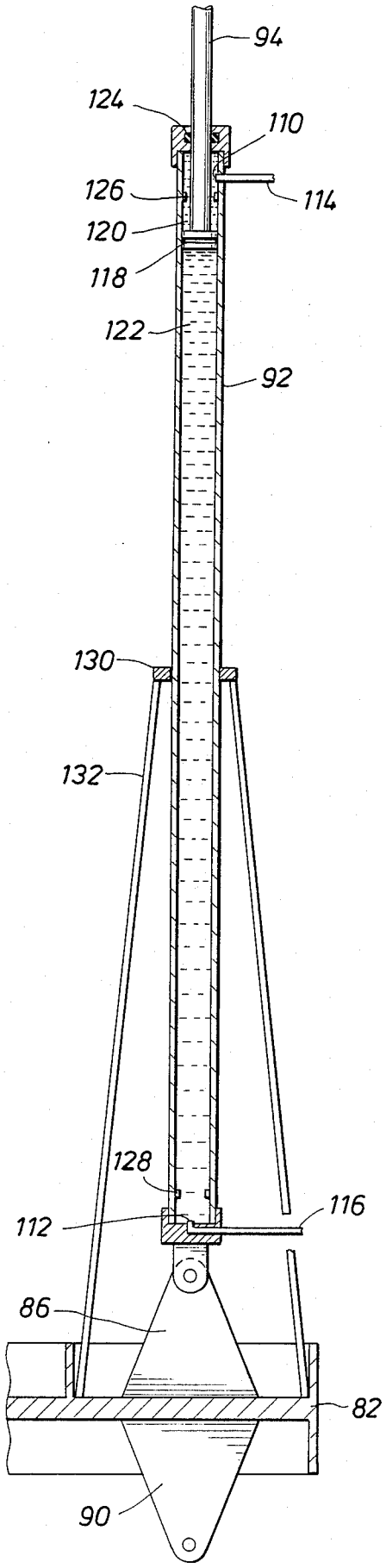
FIG. 4 is a cross-sectional view of a piston assembly of the heave compensated stabbing and landing tool of FIG. 2.
Figure 5:
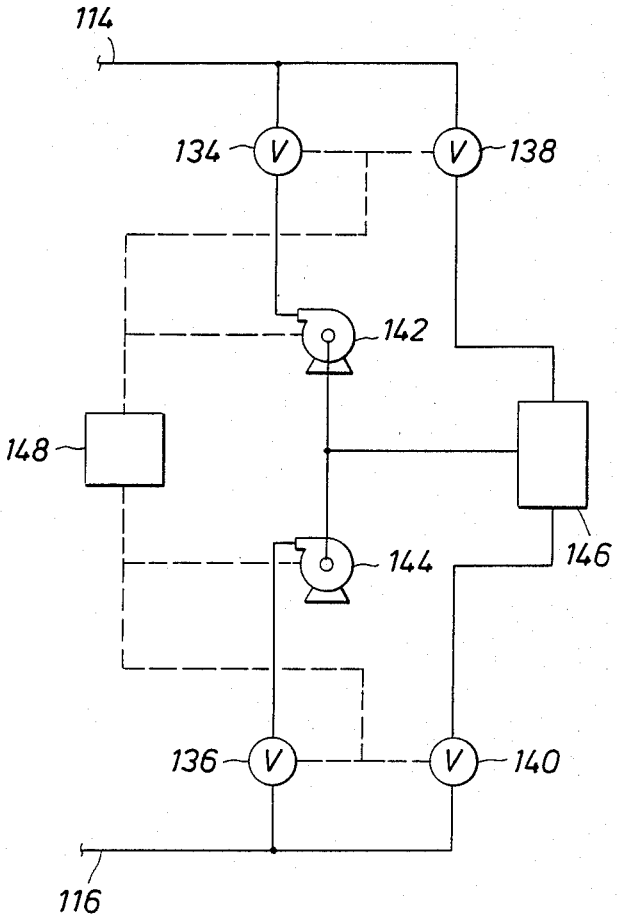
FIG. 5 is a schematic of a hydraulic control system.

Referring to FIGS. 2, 4, and 5, a preferred construction for the piston assemblies 74 and a schematic of a control system are shown. In the preferred embodiment, dual piston assemblies 74 are used. However, the number of piston assemblies may be fewer or greater if desired. Preferably, the piston assemblies 74 and the control system are hydraulically operated. The piston assemblies 74 and the control system therefore may comprise any one of a number of well known hydraulic, pneumatic, mechanical, and/or electromechanical arrangements familiar to those skilled in the art such as those disclosed in the heave compensation apparatus patents mentioned above.

As shown in FIGS. 2 and 4, the piston assemblies 74 are identical. Each comprises a cylinder 92 attached to the upper bearing pad 86 of lower spider assembly 72. The cylinder 92 has a port 110 at its upper end and a port 112 at its lower end, connected to conduits 114 and 116, respectively. A piston 118, divides the interior of the cylinder 92 into an upper chamber 120 and a lower chamber 122. The piston rod 94, which is attached to lower bearing pad 88 of upper spider assembly 70, extends into the upper end of piston cylinder 92 and is attached to piston 118. A seal 124 in the upper end of piston cylinder 92 seals the piston rod 94 to prevent leakage of fluid from piston chamber 92. The interior of the cylinder 92 also includes upper and lower shoulders 126 and 128 to limit the movement of the piston 118 in the cylinder 92 and prevent the piston 118 from covering openings 110 and 112. The exterior of the cylinder 92 preferably includes a stabilizing ring 130 with stabilizer bars 132 mounted thereto and to frame 82.

Conduits 114 and 116 are inlets and outlets for hydraulic fluid from the upper and lower chambers 120 and 122 of piston chamber 92. As fluid enters the upper chamber 120 through the conduit 114, the piston 118 and piston rod 94 are forced downward through fluid chamber 92 and fluid is displaced from lower chamber 122 through conduit 116. Conversely, as fluid enters the lower chamber 122 through conduit 116, the piston 118 and piston rod 94 are forced upward through the cylinder 92 and fluid is displaced from the upper chamber 120 through conduit 114. The movement of the piston 118 and piston rod 94 is thus controlled by fluid flow into and out of the chambers 120 and 122.

Referring to FIG. 5, the hydraulic fluid control circuit for piston assemblies 74 is shown schematically and comprises inlet valves 134 and 136 connected to conduits 114 and 116, respectively; outlet valves 138 and 140 also connected to conduits 114 and 116, respectively; inlet fluid pump 142 connected to valve 134; inlet fluid pump 144 connected to valve 136; a fluid reservoir 146; and a control switch 148. Control switch 148 opens and closes valves 134, 136, 138, and 140, and operates fluid pumps 142 and 144, as detailed below.

To move the piston 118 and retract the piston rod 94 into the piston chamber 92, valves 134 and 140 are opened, valves 136 and 138 are closed, and pump 142 is actuated by the control switch 148. Hydraulic fluid is pumped from the reservoir 146, through pump 142, valve 134 and conduit 114 into the upper chamber 120. As the piston 118 and piston rod 94 move downwardly through cylinder 92, the fluid in lower chamber 122 is displaced through conduit 116 and valve 140 back into the reservoir 146. Once the piston 118 and piston rod 94 are at the desired position, valves 134 and 140 are closed and pump 142 is deactivated through switch 148, thereby preventing fluid flow through piston cylinder 92 and movement of the piston 118 and piston rod 94.

To extend the piston rod 94 from the piston cylinder 92, valves 136 and 138 are opened and pump 144 is actuated by control switch 148. Fluid is pumped from the reservoir 146 through pump 144, valve 136 and, conduit 116 into the lower chamber 122 forcing the piston 118 and piston rod 94 to move upwardly. As the piston 118 and piston rod 94 move through piston cylinder 92, the fluid in upper chamber 120 is displaced through conduit 114 and valve 138 back into the fluid reservoir 146. Again, movement of piston 118 and piston rod 94 is halted by deactivating pump 144 and closing valves 136 and 138 with switch 148.

In a stabbing and/or landing operation, the equipment package 52 is attached to the base of the tubing string 48 and lowered through the opening 50 in the vessel 10 into the body of water 12. A line 68 is attached to the lower bearing pads 90 of the landing tool 56 to anchor the landing tool 56 to the seabed 54. The landing tool 56 is connected to the tubing string 48 by opening the gates 104 of the landing tool 56, and extending the piston rods 94 fully from the cylinders 92. The tubing string 48 is inserted into the housings 100 and 102 of the spiders 76 and 78, the gates 104 are replaced, and the grips 96 and 98 are closed to firmly hold tubing string 48.

Once the landing tool 56 is securely attached to the tubing string 48 and thus to the hook frame 44 of the heave compensator 30, the traveling block 22 is raised to tighten lines 60, 64, and 68. As the traveling block 22 is raised, the tension on the tubing string and on the anchors 58 increases. Preferably, the tension is increased until the drill string compensator is pulling up with a force that exceeds the weight of the tubing string, landing tool and equipment package by about 10,000 pounds. The drill string compensator 30 reacts by retracting piston rods 38 into piston cylinders 34. The traveling block 22 should be raised until the desired retraction of the piston rods 38 has occurred, preferably this is about one-fourth of the full piston stroke.

At this point, the landing tool 56 in cooperation with the anchor lines and the drill string compensator 30 fully compensates the tubing string 48 for any motion from heaving of the vessel 10. When heave causes the vessel 10 to move vertically with respect to the seabed 54, the drill string compensator 30 continuously adjusts for the motion of the vessel, thereby maintaining the tubing string 48 and the equipment package 52 at a constant height above the seabed 54. For example, if the vessel 10 moves toward the seabed, the drill string compensator 30 will react by extending piston rods 38 from piston cylinders 34 to take up any slack in lines 60, 64, and 68, and maintain the tension within tubing string 48. If the vessel 10 rises with respect to the seabed, lines 60, 64, and 68 tighten and the drill string compensator 30 will simultaneously react to retract piston rods 38 into piston cylinders 34.

Once the landing tool 56 and the drill string compensator 30 are set as desired, the landing operation commences by opening the grips 98 to release the tubing string 48 from the lower spider assembly 72. Grips 96, however, remain firmly closed around drill pipe 48. Pistons 118 and piston rods 94 are then retracted into piston cylinders 92 by operating the control switch 148 and the tubing string 48 and the equipment package 52 are lowered towards seabed 54. During the lowering of the tubing string 48 and equipment package, the landing tool 56 in cooperation with drill string compensator 30 continuously compensates for heaving of the vessel.

When the pistons 118 and piston rods 94 of the landing tool 56 are fully withdrawn into the cylinders 92, the lower grips 98 are closed around the tubing string 48 and the upper grips 96 opened. The tubing string 48 and equipment package 52 are held in place while the piston rods 94 are extended from the cylinders 92. The drill string compensator will accommodate the upward extension of the piston rods. Once the rods are fully extended, the upper grips 96 are closed around the tubing string 48, the lower grips 98 are released, and the retraction of the piston rods 84 into the cylinders 92 may be repeated as desired to lower the tubing string 48 further.

Initially as the tubing string 48 and equipment package 52 are lowered, the traveling block 22 is held stationary. The lowering of the tubing string 48 and equipment package causes the drill string compensator 30 to retract piston rods 38 into piston cylinders 34 to maintain the constant tension in the tubing string 48. As the tubing string 48 continues to move downward toward the seabed, the piston rods 38 of the drill string compensator 30 may become fully retracted into the piston cylinders 32 so that the ability of drill string compensator 30 to adjust may be affected. Prior to this point, the traveling block 22 is gradually lowered, which causes piston rods 38 to extend from piston cylinders 32 and offset the retraction caused by the lowering of tubing string 48. During lowering of the traveling block 22, the landing tool 56 in cooperation with the drill string compensator 30 will continue to compensate for heaving of the vessel 10 as well as compensating for the lowering of traveling block 22 and the lowering tubing string 48 by tool 56.

Once the landing and stabbing operation is complete, the landing tool 56 is detached from the tubing string 48 by lowering the traveling block 22 to release the tension in lines 60, 64, and 68 and drill string compensator 30, opening grips 96 and 98 as to release the tubing string 48, opening the gates of the upper and lower spider assemblies 70 and 72 and removing the landing tool 56.

Modifications and variations of the embodiment described above may be made without departing from the concept of the present invention. Accordingly, the form of the invention described and shown herein is exemplary only, and is not intended as a limitation on the scope thereof.

We claim:

1. A heave compensated stabbing and landing tool for use on a vessel including a drill string compensator and a tubing string connected to the drill string compensator, comprising:

an upper tubing grip having a first engaged position in which it grips the tubing string and a second disengaged position;

a lower tubing grip having a first engaged position in which it grips the tubing string and a second disengaged position;

means connected to the upper and lower tubing grips for selectively adjusting the vertical distance therebetween to allow controlled vertical placement of the lower end of the tubing string; and a separater anchor line having a first end connected to the lower tubing grip and a second end adapted to be anchored to the seabed, wherein the anchor line is adapted to anchor the tool to the seabed independently of the drill string.

2. The heave compensated stabbing and landing tool of claim 1 wherein the upper and lower tubing grips comprise spiders and slips.

3. The heave compensated stabbing and landing tool of claim 2 wherein the means for selectively adjusting the vertical distance between the upper and lower tubing grips comprises at least one cylinder and piston assembly, comprising a cylinder, a piston in the cylinder and a piston rod connected to the piston, wherein the piston rod and the cylinder are connected to the upper and lower tubing grips.

4. The heave compensated stabbing and landing tool of claim 3 wherein the spiders and slips are remotely adjustable from first positions in which they grip the tubing to second positions in which they do not grip the tubing, and further comprising means for remotely actuating the spiders and slips from the first positions to the second positions.

5. The heave compensated stabbing and landing tool of claim 4 wherein the upper and lower tubing grips comprise upper and lower spider assemblies, respectively, and wherein the cylinder is connected to the lower spider assembly, the piston rod is connected to the upper spider assembly and the anchor line is connected to the lower spider assembly.

6. A method for use on a vessel including a drill string compensator for stabbing or landing on the seabed an object on a tubing string, comprising the steps of:

connecting the tubing to the drill string compensator;

gripping the tubing at a first location with a first tubing grip;

gripping the tubing at a second location with a second tubing grip;

connecting the second tubing grip to an anchor line fixed to the seabed;

lifting the drill string compensator with respect to the vessel to tension the anchor line, thereby substantially eliminating relative vertical movement between the object on the tubing string and the seabed;

releasing the tubing from the second tubing grip; and selectively decreasing the distance between the first and second tubing grips, thereby increasing the relative tension on the drill string compensator and stabbing or landing the object on or at the seabed.

7. The method of claim 6 further comprising the steps of:

gripping the tubing at a third location above the second location with the second tubing grip;

releasing the tubing from the first tubing grip; and selectively increasing the distance between the first and second tubing grips.

8. The method of claim 7 further comprising the step of lowering the drill string compensator with respect to the vessel to reduce the tension between the drill string stabilizer and the seabed anchor line.

9. The method of claim 8 wherein an upward force in the range of about 10,000 pounds is maintained on the anchor line by the drill string compensator.

* * * * *